US007389875B2

(12) United States Patent
Sandberg et al.

(10) Patent No.: US 7,389,875 B2
(45) Date of Patent: Jun. 24, 2008

(54) LOCKING SLEEVE PACKAGE AND BLANK THEREFOR

(75) Inventors: Lars Sandberg, Hammarö (SE); Marcus Dehlin, Karlstad (SE); Antje Rosentreter, Karlstad (SE)

(73) Assignee: Stora Enso AB, Karlstad (SE)

( * ) Notice: Subject to any disclaimer, the term of this patent is extended or adjusted under 35 U.S.C. 154(b) by 330 days.

(21) Appl. No.: 11/019,398

(22) Filed: Dec. 23, 2004

(65) Prior Publication Data

US 2006/0131205 A1 Jun. 22, 2006

(30) Foreign Application Priority Data

Dec. 21, 2004 (SE) ..... 0403099

(51) Int. Cl.
*B65D 83/04* (2006.01)

(52) U.S. Cl. ..... 206/531; 206/1.5; 206/539; 229/125.125

(58) Field of Classification Search ..... 206/531–532, 206/538–539, 1.5; 229/125.125
See application file for complete search history.

(56) References Cited

U.S. PATENT DOCUMENTS

| | | | | |
|---|---|---|---|---|
| 6,047,829 | A * | 4/2000 | Johnstone et al. | 206/531 |
| 6,168,073 | B1 * | 1/2001 | Towle | 229/125.125 |
| 6,230,893 | B1 * | 5/2001 | Karow | 206/531 |
| 6,491,211 | B1 | 12/2002 | Evans et al. | |
| 6,789,677 | B2 * | 9/2004 | Maietta | 206/538 |
| 6,874,636 | B2 * | 4/2005 | Paliotta et al. | 206/531 |
| 7,090,079 | B2 * | 8/2006 | Ehrlund | 206/531 |
| 2007/0181458 | A1 | 8/2007 | Ehrlund | |

FOREIGN PATENT DOCUMENTS

| | | |
|---|---|---|
| CA | 904804 | 7/1972 |
| EP | 1 002 744 | 5/2000 |
| JP | 2000095230 | 4/2000 |
| WO | WO 02/38454 | 5/2002 |
| WO | WO 03/101840 | 12/2003 |

* cited by examiner

*Primary Examiner*—Bryon P Gehman
(74) *Attorney, Agent, or Firm*—Buchanan Ingersoll & Rooney PC

(57) ABSTRACT

A package includes a top panel, a bottom panel, a first side panel connecting the top panel and the bottom panel to each other and a second side panel also connecting the top panel and the bottom panel to each other. The bottom panel, the first side panel, the top panel and the second side panel form a sleeve having a cross-section essentially formed as a rectangle. The sleeve is adapted to slidably receive an insert along a sliding direction normal to the rectangle. The package includes a locking member which includes an arch-shaped portion extending into the rectangular cross section to releasably retain the insert. The present disclosure also relates to a blank for forming the package.

25 Claims, 8 Drawing Sheets

Fig 4
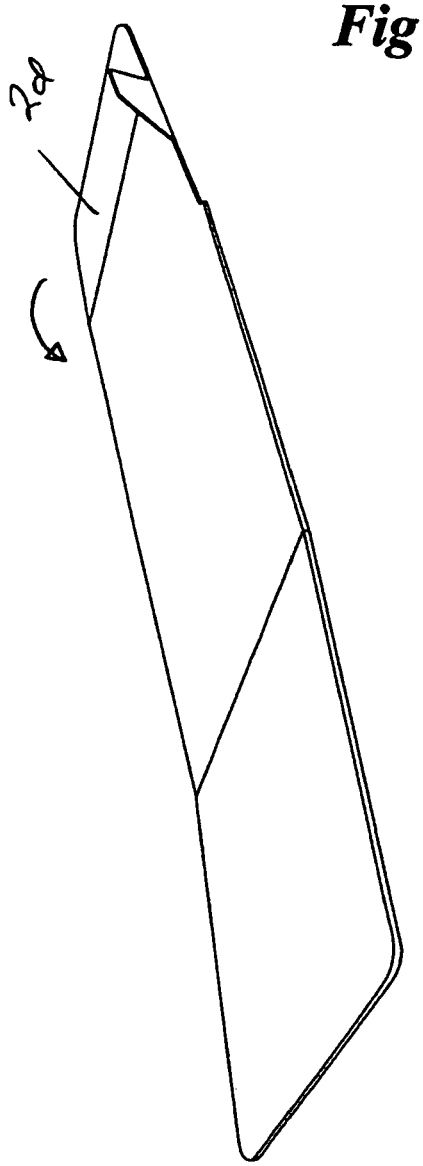
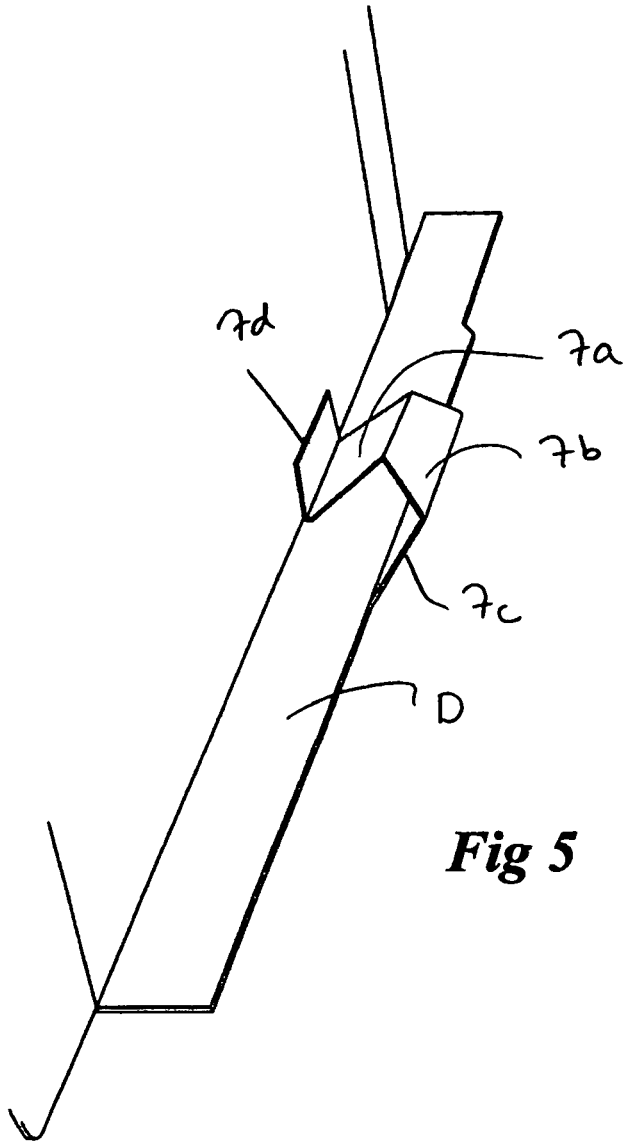
Fig 5

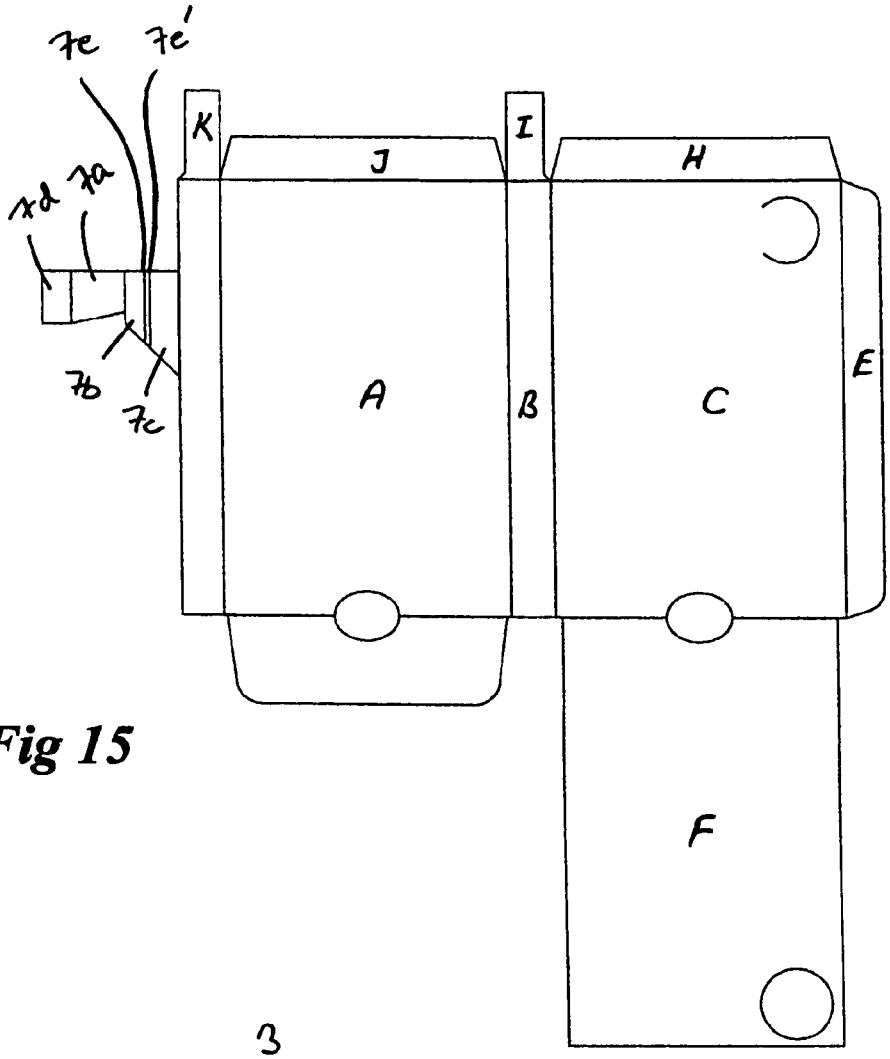
Fig 15
Fig 8
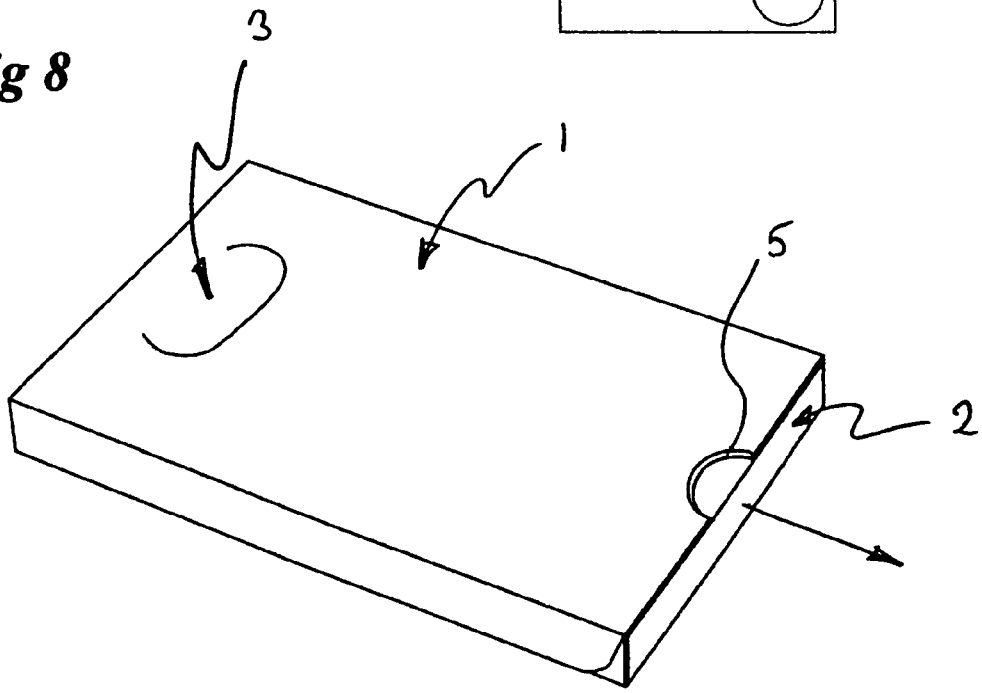

LOCKING SLEEVE PACKAGE AND BLANK THEREFOR

The present application claims priority under 35 U.S.C. § 119 patent application Ser. No. 0403099-5 filed in Sweden on Dec. 21, 2004.

FIELD OF INVENTION

The present invention relates to a controlled easy-access package for child resistant, senior-friendly storage of unit dose products or the like. The package is provided with a locking function preventing a child from getting access to the product inside the package. The package can be opened and closed numerous times and then finally disposed of.

TECHNICAL BACKGROUND

EP 1 002 744 A1 discloses a two-piece paperboard container that houses a unit dose product on an internal slide card within an outer paperboard shell. This package has two internal locks that prevent the slide card from being pulled out without triggering a lock release mechanism. This package is focused around providing a child resistant, senior-friendly unit dose package that can be opened and closed numerous times and then finally disposed of.

The paperboard shell is formed by folding a blank consisting of three major panels connected by two narrow panels. The centre major panel of the blank is adapted to form a bottom surface of the package, whereas one of the two outer major panels of the blank is adapted to form a top surface of the package. The other outer panel is adapted to form an inner top surface of the package. The inner top surface and the top surface are glued to each other.

The panel forming the inner top surface is provided with a through-going opening or cut-out. The panel forming the top surface is provided with a score line formed as an oval. The panel is cut through along this score line. The oval score line and the through-going opening are positioned on the two outer panels in such a manner that when forming a package the oval score line will be positioned on top of the through-going hole. The portion of the panel being within this oval score line may be pushed as a push-button.

The internal slide card is provided with a tab, which is formed at the leading edge (leading when the slide card is inserted into the package) and refolded backwards over the slide card. When the slide card is inserted completely inside the shell, the refolded tab will due to its spring-back properties enter into the through-going opening of the panel forming the inner top surface.

When a user pulls the slide card the tab will be forced into the through-going opening and thus block the slide card from being pulled out of the package. However, if the user pushes the push-button the tab will be pushed out of the through-going opening and the slide card may thus be pulled out of the package.

At the opening, through which the slide card is inserted into the package, the package is provided with an inwardly folded tab, which interacts with the refolded tab of the slide card to prevent the slide card from being pulled completely out of the package.

However, this package does not represent a satisfactory design. Already when a refolded tab looses only a portion of its spring-back properties (after being pushed inwardly a few times) it will not make a complete spring-back movement. The design of the package disclosed in EP 1 002 744 A1 relies on the thickness of the panel forming the inner top surface.

The locking function is thus made dependent upon the selection of sufficiently thick material for the package. Consequently, already minor short-comings of the spring-back of the refolded tab will result in that the refolded tab will not enter the through-going opening and the locking function is not accomplished. Moreover, any lack of spring-back of the push-button will result in that the push-button will occupy a space in the through-going opening and thus exert a force onto the refolded tab being counterproductive to the spring-back of the refolded tab.

WO 02/38454 A1 discloses a package made of cardboard, comprising a sleeve and an insert, the sleeve being provided with at least one catch tab located on the inside of the sleeve and provided with at least one projection, so that the catch tab forms an angle with the upper wall of the sleeve. At least one locking tab is provided on the insert, which is arranged so as to be at least in part inserted between the catch tab and the upper wall. At least one operating tab is provided, in addition to which the sleeve is provided with at least one cut-out next to the operating tab, the operating tab being arranged so as to be pressed by a user against locking tab, movement of the insert in the sliding direction towards the opening being made possible. Although it has been found that this design offers a satisfactory locking function it has been proven difficult to use this design for so-called flat-laid, pre-glued distribution of a package.

WO 03/101840 A1 discloses a package comprising a sleeve of essentially parallelepipedal shape, and an insert, which can be inserted into and withdrawn from the sleeve in a sliding direction through an opening in the sleeve, the sleeve comprising four longitudinal walls, which are essentially parallel to the sliding direction. The package is characterized in that the sleeve is provided with a first stop tab which extends from a first to a second of the longitudinal walls, the tab being at least partly separated from the first longitudinal wall and the second longitudinal wall in that the insert has a first locking edge, the insert being prevented, upon contact of the first locking edge with the first stop tab, from moving out of the sleeve, and in that the first locking edge can, by elastic deformation of a part of the insert by means of manoeuvring by a user, be moved so that its movement past the first stop tab is made possible.

Although it has been found that this design offers a satisfactory locking function it has been proven difficult to use this design for so-called flat-laid, pre-glued distribution of a package.

SUMMARY OF THE INVENTION

Thus, it is an object of the invention to provide a basic design of a locking function which on one hand provides a satisfactory locking function and which on the other hand offers the possibility of easily being adapted for so-called flat-laid, pre-glued distribution of a package being provided with said locking function.

This object has in accordance with the invention been achieved with a package comprising a top panel, a bottom panel, a first side panel connecting the top panel and the bottom panel to each-other and a second side panel also connecting the top panel and the bottom panel to each other, wherein the bottom panel, the first side panel, the top panel and the second side panel form a sleeve having a cross-section essentially formed as a rectangle, wherein the sleeve is adapted to receive an insert being slidable within said sleeve along a sliding direction being normal to said rectangle, wherein the package further comprises a locking member extending from a first position located at or at a first distance from a first inside corner of the rectangle, into the cross-section and to a second position located at or at a second distance from a second inside corner of the rectangle, and that the locking member forms a continuous or broken arch within said cross-section. By introducing a locking member of this kind it is possible to achieve a satisfactory locking function. The locking member will extend as a continuous arch or as a broken arch, for example as a trapezoid or a flattened V-shape, into the cross-section of the sleeve. An arch will have a portion extending from an inside surface of the package wall into the cross-section of the package and another portion extending back to an inside surface of the package wall. Thus, the arch will during a portion of its extension be located a distance from all the inside surfaces of the walls. The arch may have any geometrical shape introducing this portion extending into the cross-section and located at a distance from the inside walls. An insert introduced into the sleeve may be designed with great design-freedom since the locking member establishes a robust design considering the locking function. An insert provided with locking tabs folded, along a line essentially parallel with or slightly inclined in relation to the sliding direction, back over the insert may be inserted into the sleeve. The locking member will during this insertion force the locking tabs to be refolded to pass further into the sleeve. The locking tabs of the insert are, after passing the locking member, allowed to spring back behind or into an opening of the locking member. When the insert is to be removed from the sleeve, the locking tab will not be allowed to pass the locking member. One or more panels, in the preferred embodiments the top panel, is provided with a partial cut-out such that a portion of the panel may be folded into the sleeve and exert a force onto the locking tab of the insert. The locking tab is thus refolded to an extent where it may pass the locking member of the package. Since the locking member will extend as an arch it will not be associated with problems of slight lack of spring-back of the locking tab or the like. Even when the locking tab looses a significant amount of its spring-back the locking function will still work since a significant refolding is needed for allowing passage of the locking tab past the locking member.

With the above mentioned positioning of the locking member in relation to the cross-section of the sleeve it is possible to adapt the basic design for flat-laid distribution of the package. It should be noted that when discussing flat-laid, pre-glued distribution several different possibilities are considered. A non-exhaustive listing involves a flat-laid package with pre-glued side panels and pre-glued locking member, a flat-laid package with a locking member pre-glued but with the side panels not being glued, an non-folded blank where the locking member is pre-glued (almost as a flat-laid package with only the locking member pre-glued). Thus, pre-glued can refer to the gluing of the locking member and/or the gluing of the side panels.

In accordance with an aspect of the invention the locking member is a flattened V-shaped bridge extending from an upper left corner to an upper right corner of the sleeve. The bridge has an arc length being longer than the straight distance between the two corners and will thus be forced to extend into the cross-section of the sleeve. When the package is flat-laid the panels being laid parallel with each other will exhibit an imaginary lengthening. This is due to the fact that a paperboard does not fold about a single geometrical line but will actually be bent and deformed in a folding area. However, within the field of the invention a fold line is the terminology used for such a folding. Thus, when flat-laid, the package will allow the locking member to form a straight line without any undesired folding of the locking member counteracting the flat-laying of the package. The locking member may extend from a point a first distance from the upper left corner along the second side panel to a point a second distance from the right upper corner along the first side panel. If the first distance is equal to the second distance the above-mentioned imaginary lengthening will still occur. If the first distance is larger than the second distance and the package is flat-laid such that the second side panel is folded against the bottom panel an additional imaginary lengthening will occur since the first position of the locking member will not be translated along the bottom panel the same amount as the second position. The bridge-forming locking member may as a blank have the same length as the corresponding top panel, if it is connected to the insides of the side panels, since it then will experience an imaginary shortening of the available space when the package is erected. Thus, the locking member will extend as an arch into the cross-section.

In accordance with an aspect of the invention the locking member is formed as a broken arch extending from a first position a first distance from an upper left corner along the top panel to a second position in a lower left corner. When the package is flat-laid the locking member will collapse further into the cross-section. If the distance from the lower left corner along the second side panel and along the top panel to the first position is equal to the arc length of the locking member the locking member will allow flat-laying of the package. Compared to this situation the first and second position may be translated along the top panel and the bottom panel respectively the same amount. The relevant distance will then be the geometrical distance between the second position to the top panel added to the relative displacement of the first position compared to the second position. This relevant distance should be equal to the arc length of the locking member. It is also possible that the first position is in the upper left corner and the second position is in the lower left corner. In such a design a portion of the locking member will extend along or at a point abut the top panel. This additional portion will form an imaginary first position and the relevant distance will be defined as above. It is also possible that the first position is located at a first distance from the upper left corner along the second side panel. The locking member will also in this case have a portion that extends towards and abuts the top panel thus forming an imaginary first position.

Thus, the above-mentioned features of the invention disclose a basic design, which may be adapted in numerous ways to allow flat-laying of the package. It should be noted that the locking member thus formed will automatically be erected when the flat-laid package is erected into a rectangular sleeve. The geometrical constraints will force the locking member to adopt the desired position as described above.

If the locking member is formed by a separate member, the first position may be significantly displaced along the top panel in respect of the first aspect of the invention. However, in any case the first and second distance is correlated to a given, associated corner and said distances are along a panel folded about said corner. Thus, a locking element having one or both of the first and second positions displaced a distance from the associated corner will display essentially the same pattern of movement as a locking member having the first and second positions located at said corners.

The locking member may also be formed of a cut-out in one of the panels forming the walls of the package. Such a cut-out will be folded inwardly into the package and fastened to another one of the side walls as described above. The locking member may e.g. be formed by a cut-out in the top panel; the cut-out being formed by two cuts from a side panel and a cut joining said two cuts at a central portion of the top panel. The locking member thus formed may be folded about a geometrical line extending between the two cuts from the side panels and being parallel to the fold lines between the panels. The geometrical line may be located in a corner of the package or at a given distance from the corner. By folding the cut-out into the cross-section and fasten it to another panel this will result in a locking member in the same manner as the one being formed by a separate member or by a portion added to the blank. This will however, result in portion of the package being provided with an opening, which may be covered by another panel. If the cut-out is formed in a reinforcement panel located inside another outer panel, the cut-out locking member may be formed without getting any undesired openings into the package.

It should be noted that the rectangle might also be formed as a square having four sides with equal length.

Preferred embodiments of the invention are defined in the dependent claims.

Preferably, the first inside corner and the second inside corner are located at two opposite edges of one of said panels. This way a change in geometry when flat-laying/erecting the package will impart a change in distances experienced by the locking member compared to the change in distances by the sleeve as such. If they are located in or at a given distance from said corners the folding of the package about said corners will impart said difference in experienced distances.

Preferably, the bottom panel and the first side panel are foldable in relation to each other about a first fold line forming a hinge between the bottom panel and the first side panel, the first side panel and the top panel are foldable in relation to each other about a second fold line forming a hinge between the first side panel and the top panel, the top panel and the second side panel are foldable in relation to each other about a third fold line forming a hinge between the top panel and the second side panel, and wherein the second side panel and the bottom panel are foldable in relation to each other about a fourth fold line forming a hinge between the second side panel and the bottom panel. This way the package may easily be flat-laid. It also makes it possible to form the package from a blank folded about said fold lines.

Preferably, the sleeve is collapsible by simultaneous folding of the side panels in one and the same folding direction about the first and third fold lines, respectively, in relation to the bottom panel such that the second side panel is folded towards the bottom panel, and wherein said first inside corner of the rectangle is defined by the top panel and the second side panel.

Preferably, the second side panel comprises a first side panel portion connected to the bottom panel and a second side panel portion connected to the top panel, whereby an outer surface of the first portion abuts and is attached to an inner surface of the second portion. This way it is easy to design a blank for the complete forming of the package. Moreover, the above discussed placement of the first corner compared to the divided side panel will give an additional benefit when it comes to flat-laying packages as such. A package with a side panel of this kind allows without obstacles a flat-laying where the corner or fold line between the outer side panel (the first portion) and the top panel is opened or un-folded such that the first portion and the top panel forms a continuous surface. If the first and second portion was arranged in the opposite way, i.e. the first portion outside the second portion, the first corner should be redefined to be the corner between the bottom panel and the first portion. A package folded the other way around will experience buckling of the panels or demand differences in panel lengths.

Preferably, the locking member is integrally formed with said first portion of the second side panel, thereby allowing the package to be formed from a single blank.

According to an aspect of the invention the first inside corner of the rectangle is defined by the top panel and the second side panel and the second inside corner is defined by the second side panel and the bottom panel. This forms the basis of forming the locking member at one side of the cross-section. This also forms the basis of forming the locking member having a significant extension into the cross-section, thus forming a highly reliable locking function.

Preferably, the locking member comprises a first portion and a second portion adapted to form an essentially arcuate extension into said cross-section from said second position to said first position being located at a first distance from said first inside corner along the top panel. This further improves the above mentioned advantage concerning reliable locking function. The locking member may be formed as a broken or curved arch extending from a first position a first distance from an upper left corner along the top panel to a second position in a lower left corner. When the package is flat-laid the locking member will collapse further into the cross-section.

Preferably, the first and second portions of the locking member are interconnected along a fold line parallel with said normal to said rectangle, and wherein a distance from the first position to the second position along the top panel and the second side panel essentially coincide with a distance from the first position to the second position along the first and second portions of the locking member. This way the locking member will allow flat-laying of the package without forming any obstacle.

Preferably, the first portion is adapted extend from said second position such that a geometric component along the bottom panel extends past the first position. This way it is secured that the locking member will continue to collapse into said cross-section when the package is flat-laid.

Preferably, the locking member further comprises a third portion adapted to extend from said first position located at said first inner side corner along an inside surface of the top panel to the second portion, wherein the second and third portions of the locking member are interconnected along a fold line parallel with said normal to said rectangle. This way it is easy to form the locking member as an integral part of the other panels of the package and still have a continuous outer surface of the sleeve.

Preferably, a distance from the first position to the fold line between the second and third portion along the second side panel and the third portion essentially coincide with a distance from the fold line between the second and third portions to the second position along the first and second portions of the locking member. As mentioned above this will give a situation where the additional, third portion of the locking member will together with the second portion form an imaginary first position at the fold line between the third and second portion and the relevant distance will be defined as above. The relevant distances to compare could also be defined as the distance along the second side panel together with the length of the third portion of the locking member compared to the distance or arc length of the locking member.

According to an aspect of the invention said first inside corner of the rectangle is defined by the top panel and the second side panel and the second inside corner of the rectangle is defined by the top panel and the first side panel. With this design a V-shaped or arc-shaped locking member will extend from one side to the other side of the cross-section of the sleeve. This will present a symmetrical solution, which will give good alignment properties when it comes to insertion and removal of the insert. It also gives a high degree of design freedom when it comes to designing the insert.

Preferably, a first geometric distance is defined between said first position and said second position when the sleeve is erected and has a cross-section essentially formed as a rectangle and a second geometric distance is defined between said first position and said second position when the sleeve is collapsed such that the second side panel is folded against the bottom panel, wherein the second geometric distance is larger than said first geometric distance, and wherein the locking member has a length exceeding said first geometric distance and essentially coinciding with said second geometric distance. This way, the locking member will be forced to extend into said cross-section when the package is erected, i.e. has a rectangular cross-section, and it will be formed flat along the top panel when the package is flat-laid.

The above object has in accordance with the invention also been achieved with a blank comprising a top panel, a bottom panel, a first side panel and a second side panel, the second side panel comprising a first portion and/or a second portion, wherein the bottom panel and the first side panel are foldable in relation to each other about a first fold line forming a hinge between the bottom panel and the first side panel, the first side panel and the top panel are foldable in relation to each other about a second fold line forming a hinge between the first side panel and the top panel, the top panel and any second portion of the second side panel are foldable in relation to each other about a third fold line forming a hinge between the top panel and any second portion of the second side panel, and wherein any first portion of the second side panel and the bottom panel are foldable in relation to each other about a fourth fold line forming a hinge between any first portion of the second side panel and the bottom panel, wherein said first, second, third and fourth fold lines are parallel with each other, wherein the blank further comprises a locking member extending from said first portion of the second side panel in a direction being perpendicular to said first, second, third and fourth fold lines, that the locking member and the first portion of the second side panel are foldable in relation to each other about a fifth fold line forming a hinge between said first portion and the locking member, that the fourth fold line and fifth fold line are parallel with each other and between them define said first portion, and that the locking member comprises a fastening panel being adapted to be fastened to an inside surface of the bottom panel or the first side panel.

According to an aspect of the invention, the locking member is integrally formed with said first portion of the second side panel. This way the basic design does not need to be changed dependent upon the introduction of the reinforcement panel or not. Moreover, this gives also a flexibility to change the exact location of the first position along the second side panel.

The above object has in accordance with the invention also been achieved with a blank comprising a top panel, a bottom panel, a first side panel and a second side panel, the second side panel comprising a first portion and/or a second portion, wherein the bottom panel and the first side panel are foldable in relation to each other about a first fold line forming a hinge between the bottom panel and the first side panel, the first side panel and the top panel are foldable in relation to each other about a second fold line forming a hinge between the first side panel and the top panel, the top panel and any second portion of the second side panel are foldable in relation to each other about a third fold line forming a hinge between the top panel and any second portion of the second side panel, and wherein any first portion of the second side panel and the bottom panel are foldable in relation to each other about a fourth fold line forming a hinge between any first portion of the second side panel and the bottom panel, wherein said first, second, third and fourth fold lines are parallel with each other, wherein the blank further comprises a locking member and a reinforcement panel, that the top panel and reinforcement panel are foldable in relation to each other about a sixth fold line forming a hinge between the top panel and the reinforcement panel, that the sixth fold line is perpendicular to said first, second, third and fourth fold lines, that the locking member extends from said reinforcement panel in a direction being perpendicular to said first, second, third and fourth fold lines, that the locking member and the reinforcement panel are foldable in relation to each other about a seventh fold line forming a hinge between said reinforcement panel and the locking member, that the seventh fold line is parallel with said first, second, third and fourth fold lines, and that the locking member comprises a fastening panel being adapted to be fastened to an inside surface of the bottom panel or the first side panel.

According to an aspect of the invention, the locking member is integrally formed with said reinforcement panel. This way the position of the first position along the top panel may be defined by changing the position of the fold line between the reinforcement panel and the locking member.

It has in respect of the package been discussed several advantages with the design of the locking member and the design of the package as such. The above defined blanks disclose the arrangement of the panels in respect of each other and it also defines the configuration of the locking member in relation to the different panels. If the blank is provided with a reinforcement panel this panel is adapted to be folded to the inside of the top panel and thus place the locking member (if the reinforcement panel carries the locking member) in essentially the same position as the locking member would have been placed in if it was placed directly on the first portion of the second side panel. The blank may be provided with a reinforcement panel and the locking member being carried by said first portion of the second side panel.

According to an aspect of the invention, the locking member is provided with an eighth fold line parallel with said fifth or seventh fold line, and wherein a sum of a distance between the eighth fold line and the fastening panel along the locking member and a distance between the fourth fold line and a designated fastening point of the fastening panel on the bottom panel is equal to a sum of a distance between the fourth and third fold lines as the blank is formed into a package and a distance between said fifth or seventh fold line and the eighth fold line. This will result in the continuous or broken arch shaped locking member located in the proximity of the second side panel.

According to an aspect of the invention, a first geometric distance defined between the fifth fold line and the fastening panel is larger than or equal to a second distance defined between the second and the third fold lines. This will result in the flattened V-shaped bridge extending across the entire width of the cross-section. If the distance between the fifth fold line and the fastening panel is equal to the second distance defined between the second and the third fold lines, the locking member will extend as a V-shaped or arcuate bridge due to the change in relative length experienced by the-locking member compared to the top panel due to the flat-laying and erection of the package. If the locking member is larger than said second distance it will extend as V-shaped or arcuate bridge also due to the change in relative length experienced by the locking member compared to the top panel due to the flat-laying and erection of the package. If the locking member is significantly larger than said second distance, this can be compensated for by moving the fastening points of the locking member at the different sides of the package in relation to each other.

The above object has in accordance with the invention also been achieved with a package comprising a top panel, a bottom panel, a first side panel connecting the top panel and the bottom panel to each other and a second side panel also connecting the top panel and the bottom panel to each other, wherein the bottom panel, the first side panel, the top panel and the second side panel form a sleeve having a cross-section essentially formed as a rectangle, wherein the sleeve is adapted to receive an insert being slidable within said sleeve along a sliding direction being normal to said rectangle, wherein the package further comprises a locking member extending from a first position located at or at a first distance from a first inside corner of the rectangle, into the cross-section and to a second position located at or at a second distance from a second inside corner of the rectangle, and that the locking member forms a continuous or broken arch within said cross-section and wherein the first inside corner of the rectangle is defined by the top panel and the second side panel and the second inside corner is defined by the second side panel and the bottom panel. The advantages of this design with the above features have been discussed above.

The above object has in accordance with the invention also been achieved with a package comprising a top panel, a bottom panel, a first side panel connecting the top panel and the bottom panel to each other and a second side panel also connecting the top panel and the bottom panel to each other, wherein the bottom panel, the first side panel, the top panel and the second side panel form a sleeve having a cross-section essentially formed as a rectangle, wherein the sleeve is adapted to receive an insert being slidable within said sleeve along a sliding direction being normal to said rectangle, wherein the package further comprises a locking member extending from a first position located at or at a first distance from a first inside corner of the rectangle, into the cross-section and to a second position located at or at a second distance from a second inside corner of the rectangle, and that the locking member forms a continuous or broken arch within said cross-section and wherein said first inside corner of the rectangle is defined by the top panel and the second side panel and the second inside corner of the rectangle is defined by the top panel and the first side panel. The advantages of this design with the above features have been discussed above.

BRIEF DESCRIPTION OF THE DRAWINGS

The appended schematic drawings disclose presently preferred embodiments of the invention.

FIG. 4 is a perspective view showing the insert of FIG. 3 with a tab being folded.

FIG. 5 is a perspective view showing parts of the blank of FIG. 2 with a locking tab being folded.

FIG. 8 is a perspective view showing a package according to a second embodiment of the invention.

FIG. 15 is a blank for the package shown in FIG. 1 in accordance with another preferred embodiment.

DETAILED DESCRIPTION OF PREFERRED EMBODIMENTS

Figure 1:
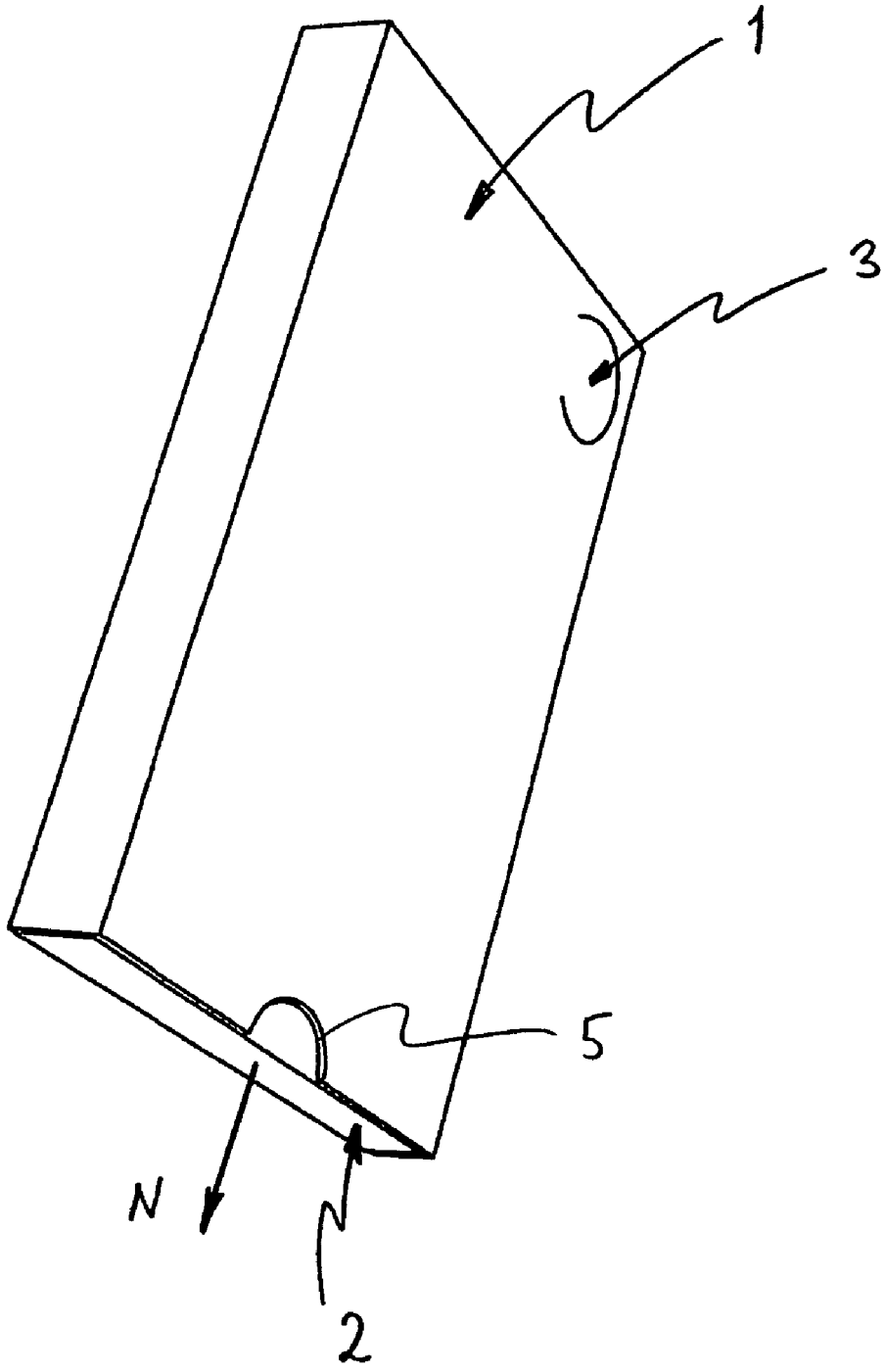
FIG. 1 is a perspective view showing a package according to a first embodiment of the invention.

In the detailed description below two embodiments will be disclosed in detail. Corresponding features will be referred to by the same reference numerals in respect of both embodiments.

As shown in FIG. 1 and FIG. 8, a sleeve 1 is adapted to receive an insert 2. The insert 2 may be removed from the sleeve 1 by a sliding motion in a sliding direction N. The sleeve 1 forms a rectangular cross-section and the sliding direction N is directed along a normal this rectangle. If the insert 2 is pulled outwardly from the sleeve 1 along the sliding direction N a locking function will prevent the insert 2 from being pulled out. The user must push a button 3 before the insert 2 is released. Moreover, if the user starts pulling the insert 2 out of the sleeve 1 before the button 3 is pushed, it will not help pushing the button 3, since the locking function in that case has reached a non-openable state. Thus, the button 3 must first be pushed to release the locking function and then the insert 2 may be pulled out of the sleeve 1. The details of this locking function will be disclosed below.

Figure 2:
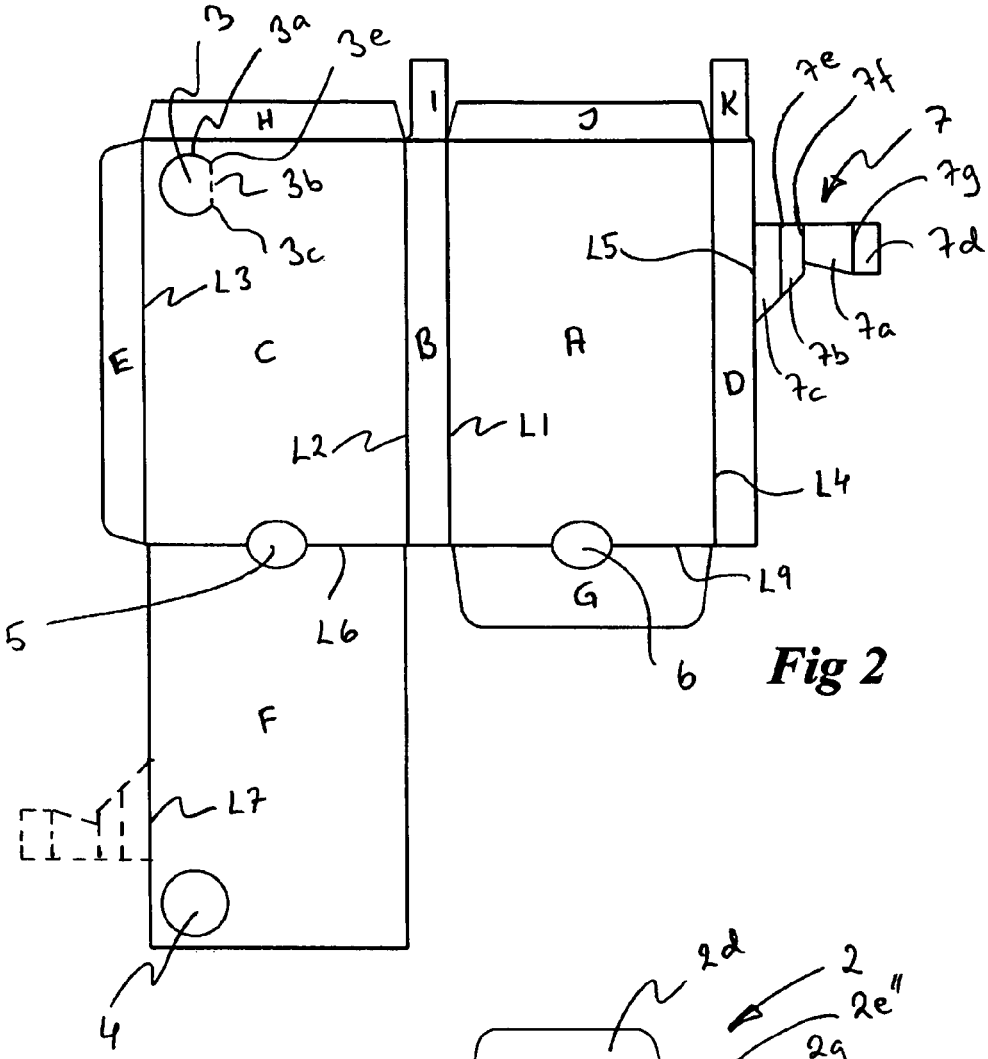
FIG. 2 shows a blank for the package shown in FIG. 1.
Figure 9:
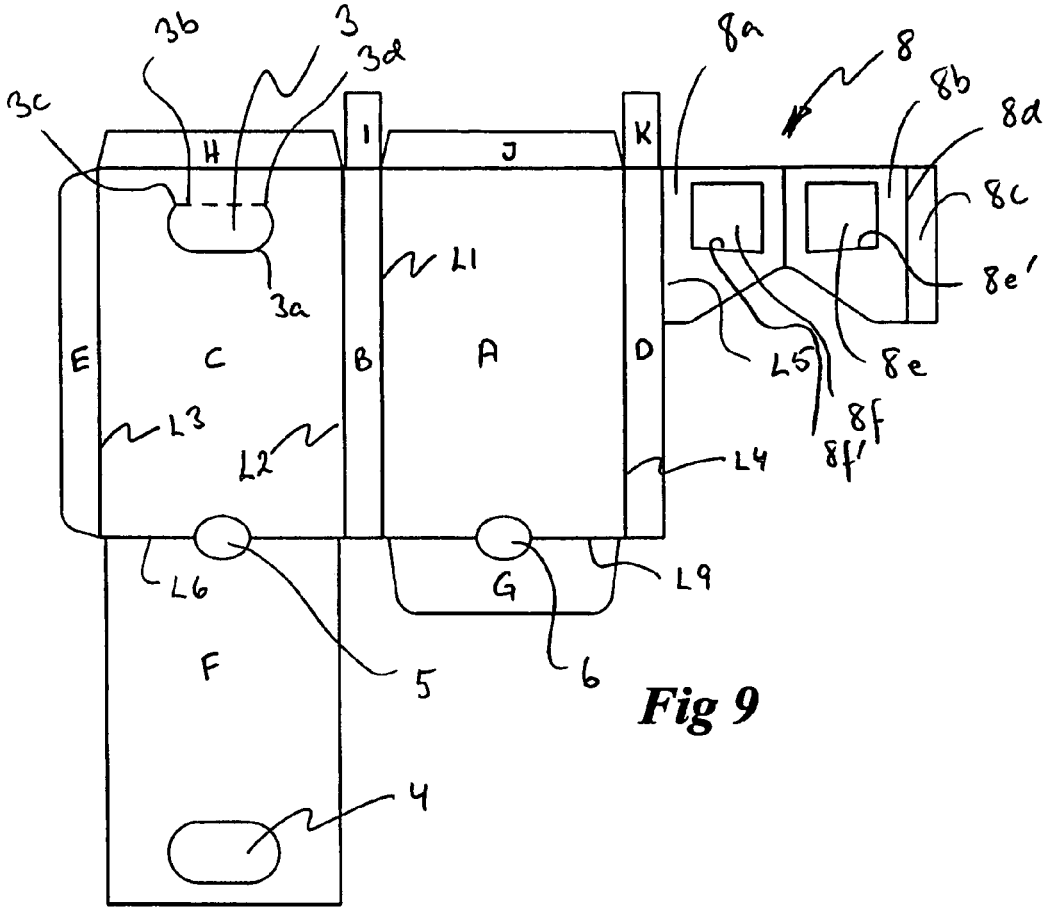
FIG. 9 shows a blank for the package shown in FIG. 8.
Figure 10:
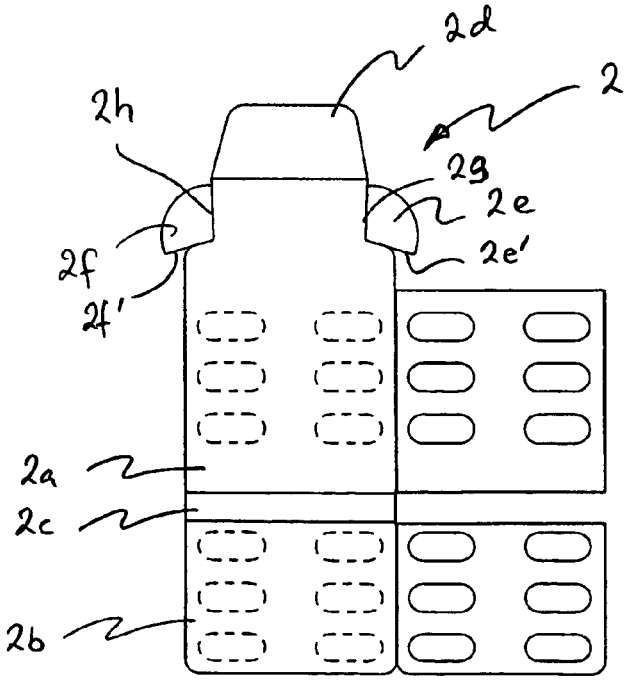
FIG. 10 shows an insert for insertion into the package shown in FIG. 8.
Figure 11:
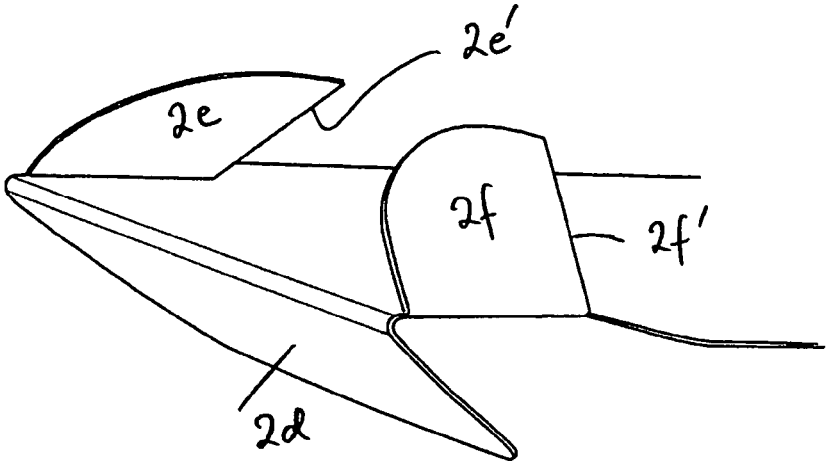
FIG. 11 is a perspective view showing the insert of FIG. 10 with a locking tab being folded.

FIG. 2 and FIG. 9 discloses two blanks for forming two packages or sleeves 1 according to said two basic embodiments. The panels will be denoted with the reference numerals A-K. Panel A is also denoted bottom panel. Panel B is also denoted first side panel. Panel C is also denoted top panel. Panel D is also denoted first portion of a second side panel. Panel E is also denoted a second portion of the second side panel. Panel F is also denoted reinforcement panel.

The panels A-F are foldable in relation to each other along a number of fold lines L1-L4 and L6. These fold lines are also denoted first to fourth fold lines and sixth fold line.

Panel A and panel B are foldable in relation to each other about fold line L1 forming a hinge between the panel A and panel B. Similarly, panel B and C are connected to each other along fold line L2, panel C and E along fold line L3, panel A and D along fold line L4 and panel C and F along fold line L6.

The blank is formed from a paperbased packaging material. The packaging material may be provided with a polymer coating. This coating will make the material more tear-resistant and more resistant to handling by a user and it will aid in giving the packaging material a spring-back function. The fold lines are formed by a creasing operation, which is well known in the art and will not be described in detail. In an embodiment the insert 2 is formed from a similar material. As will be described later the spring-back function is a relevant feature especially when it comes to designing the insert 2. The package and/or the insert may also be formed by a polymer-based material. Such a polymer material may be formed in one or several layers of the same polymer material or different polymer materials.

The panels A-F will be folded along said fold lines L1-L4, and L6 and form a sleeve 1 having a rectangular cross-section. Panel F will initially be folded and adhesively be attached to panel C such that panel F will be located inside the sleeve 1. The reinforcement panel F may cover the inside of the top panel C completely or partly. In the figures, showing the sleeve 1, panel F has been left out in order to make the drawings clear. Panels H-K will also be folded along fold lines as shown in FIG. 2 and FIG. 9. First, panels I and K will be folded inwardly and then panel J or H will be folded onto panels I and K and then the remaining panel H or J will be folded to finalise the formation of an end wall of the sleeve 1.

As can be noted in FIG. 2 and FIG. 9 the blank is not provided with any panels adapted to form a front wall of the sleeve 1. The insert 2 is provided with two panels 2*a* and 2*b* adapted to be folded onto each other about two fold lines separated by a third panel 2*c*. This third panel 2*c* is adapted to form the missing end wall of the package 1.

The two blanks are also provided with a panel G adapted to be folded about a fold line L9 into the sleeve 1. The insert 2 is provided with a corresponding panel 2*d* adapted to be refolded backwardly when the insert 2 is inserted in the sleeve 1. When the insert 2 is pulled outwardly from the sleeve 1, panel 2*d* will follow the bottom panel A of the sleeve 1 and enter into the angle formed by the bottom panel A and panel G. When the panel 2*d* hits fold line L9 it need to be unfolded to allow further removal of the insert 2 from the sleeve 1, but since the two panels 2*d* and G both have an extension perpendicular to their respective fold lines being larger than the height of the sleeve 1 they cannot be unfolded by just pulling the insert 2 outwardly. Thus, the insert 2 is prevented from being removed completely from the sleeve 1.

The top panel C is provided with a cut-out 3*a* shaped as an oval. The portion of panel C within the cut-out 3*a* will when pushed be folded into the sleeve 1 along a fold line 3*b* (creased or imaginary) extending between the ends 3*c* and 3*d* of the cut-out. Panel F is provided with a complete cut-out forming an opening 4 allowing the thus shaped push-button 3 enter into the sleeve 1.

As shown in FIG. 1-2 and FIG. 8-9, the blank is provided with cut-outs 5 and 6 between panel C and F and between panel A and G. These cut-outs will form grip-openings of the sleeve 1 making it possible to pull the insert 2 out of the sleeve 2 with simple finger-grip.

In accordance with a first basic embodiment, the blank and thus also the sleeve 1 is provided with a locking member 7 attached to panel D. As shown in FIG. 2, the locking member 7 may also be attached to the reinforcement panel F. It should also be noted that it may be formed as a separate member attached directly to the top and bottom panels as will discussed in detail below.

The locking member is divided into four panels 7*a-d* divided by three fold lines 7*e-g*. The locking member 7 is connected to panel D along a fold line L5, also denoted fifth fold line. In the alternative, the locking member 7 is connected to reinforcement panel F along a fold line L7, also denoted seventh fold line.

Figure 6:
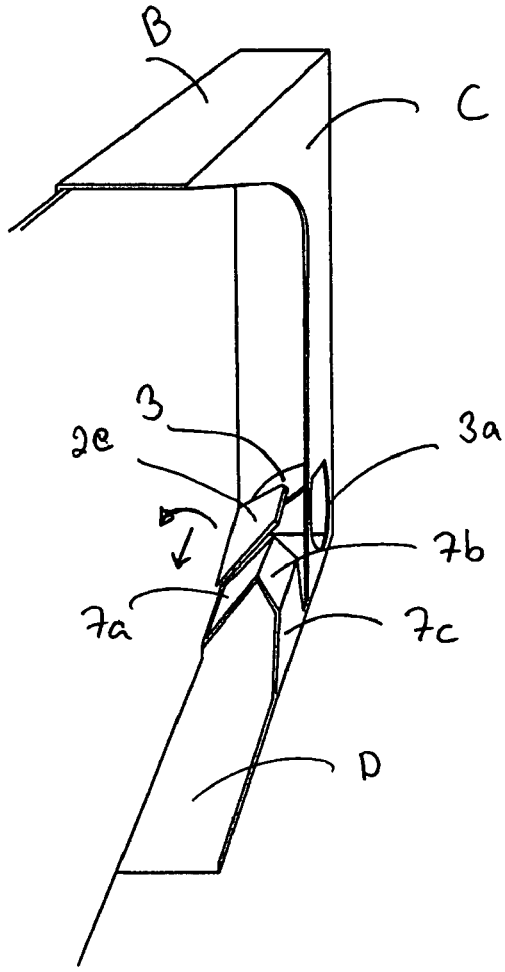
FIG. 6 is a perspective view showing the interaction of the blank of FIG. 5 and the insert of FIG. 4.
Figure 7:
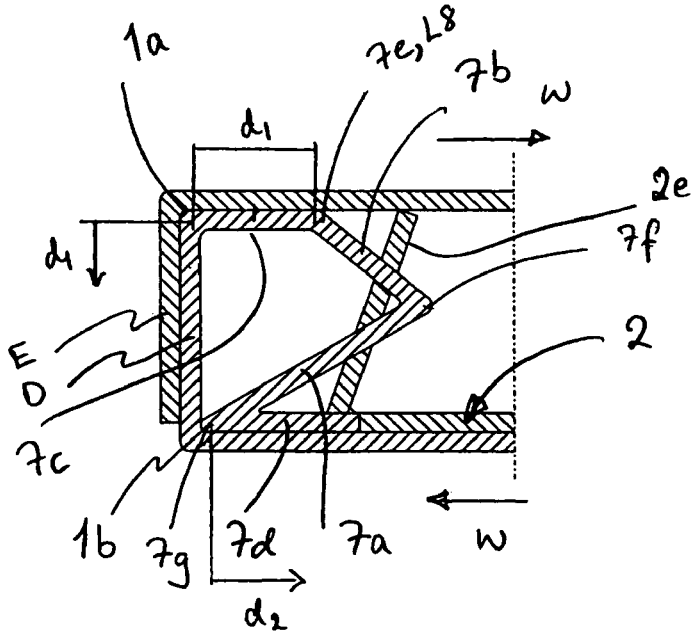
FIG. 7 is a cross-section corresponding to FIG. 6.

FIG. 5-7 shows that panel 7d, also denoted fastening panel, is fastened to the bottom panel C such that the fold line 7g will follow fold line L3 between the bottom panel C and panel E.

When the blank is formed as a rectangular sleeve 2, the locking member will extend as a broken arch into the sleeve 1. The distance between corner 1*b* to corner 1*a* and from corner 1*a* to fold line 7*e*, also denoted eighth fold line L8, is compared to the distance from fold line 7*e* to fold line 7*f* and from fold line 7*f* to corner 1*b*. If the two distances are equal to each other the locking member 7 can collapse and allow the sleeve 1 to be flat-laid. The panel 7*a* has an extension such that fold line 7*f* is located further into the cross-section than the point where fold line 7*e*, L8 is located. The panel 7*c* is not fastened to the inside of the top panel C. The panel 7*c* could according to an alternative embodiment be separated from panel D and instead be fastened to the inside of the top panel C. The point 7*e* from which the locking member 7 extends in an arc is also denoted first position. As shown in FIG. 7 the first position 7*e* is located a distance d1 from the first corner 1*a*. It has also been discussed above that the first point 7*e* and the second point 7*g*, also denoted second position, may be translated along the top panel C and the bottom panel A such that the second position also is displaced a distance d2 from the second corner 1*b*. It is also discussed above that the first position could be considered to be the connection of the locking member 7 to the panel D. Panel 7*a* is also denoted first portion, panel 7*b* is also denoted second portion and panel 7*c* is also denoted third portion of the locking member 7.

In accordance with another embodiment, the locking member 7 is provided with an additional fold line 7*e*' as disclosed in FIG. 15. In FIG. 15, only a limited number of reference numerals are noted down, since the blank corresponds to the blank in FIG. 2 with a slight difference when it comes to the design of the locking member 7. The additional fold line 7*e*' extends close to and in parallel with fold line 7*e*. The two fold lines 7*e* and 7*e*' could also be formed as a single fold line having an transverse extension (across its longitudinal extension) corresponding to the two fold lines 7*e* and 7*e*'. With the extended or double fold line it is possible to form the locking member 7 such that the arcuate extension is optimised with respect to the locking function and still may be completely flat-laid. One of the fold lines 7*e*, 7*e*' is located at the location which will fulfil the above discussed distance relationships such that the locking member 7 may be flat-laid and the other fold line 7*e*', 7*e* is located such that the locking member 7 will extend into the cross-section in the desired or optimised manner. If the location of the fold line 7*e* giving the flat-laying possibility results in a satisfactory extension of the locking member 7 into the cross-section when the package is erected it is sufficient to use only one fold line 7*e* as disclosed in the embodiment of FIG. 2. Of course the additional or transversely extended fold line 7*e*, 7*e*' may be used when the locking member 7 is formed as a separate member, an extension of the side panel portion D, as an extension of the reinforcement panel F, as a cut-out in the reinforcement panel F or as a cut-out in the top panel C.

Figure 3:
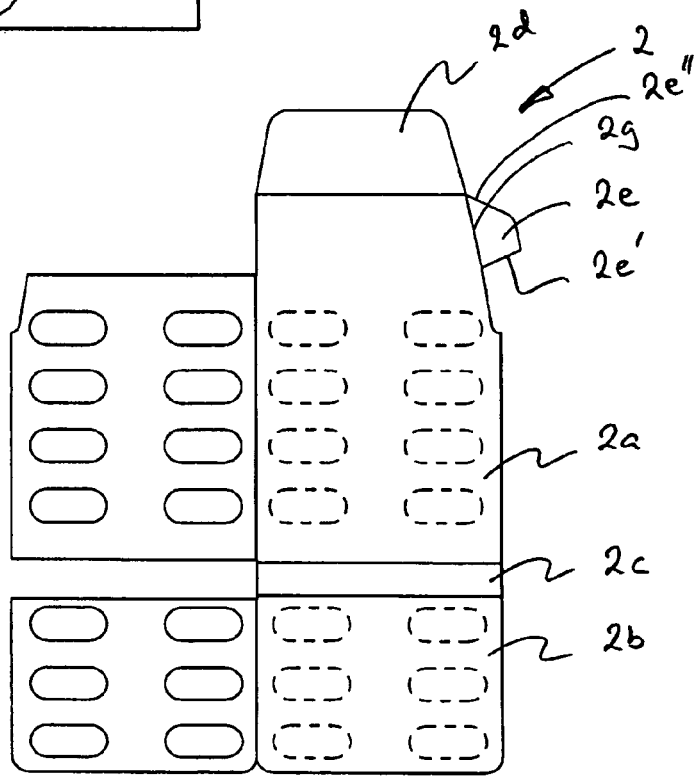
FIG. 3 shows an insert for insertion into the package shown in FIG. 1.

The insert 2 is provided with a locking tab 2*e* foldable in relation to the insert 2 along a fold line 2*g* (see FIG. 3 and FIG. 4). The trailing edge 2*e*' of the locking tab 2*e* and the angle of the folding line 2*g* are interrelated such that the leading edge 2*e*" will perpendicular to the sliding direction. The leading edge 2*e*" of the locking tab 2*e* is formed as an arch in order to form a slanted surface abutting the locking member 7 when the insert 2 is inserted into the sleeve 1. The slanted surface 2*e*" will make the locking tab 2*e* be refolded more and more as the insert 2 is inserted into the sleeve 1, such that the locking tab 2*e* finally may pass behind the locking member 7 and spring-back behind it. This situation is shown in FIG. 7. The locking member 7 is also provided with a slanted leading edge for facilitating insertion of the insert 2.

In order to release the insert from the locking mechanism the push-button 3 is pushed into the sleeve 1 and folds the locking tab 2*e* of the insert 2 to the basic plane of the insert 2 such that the locking tab 2*e* once again may pass the locking member 7. This situation is shown in FIG. 5.

Figure 12:
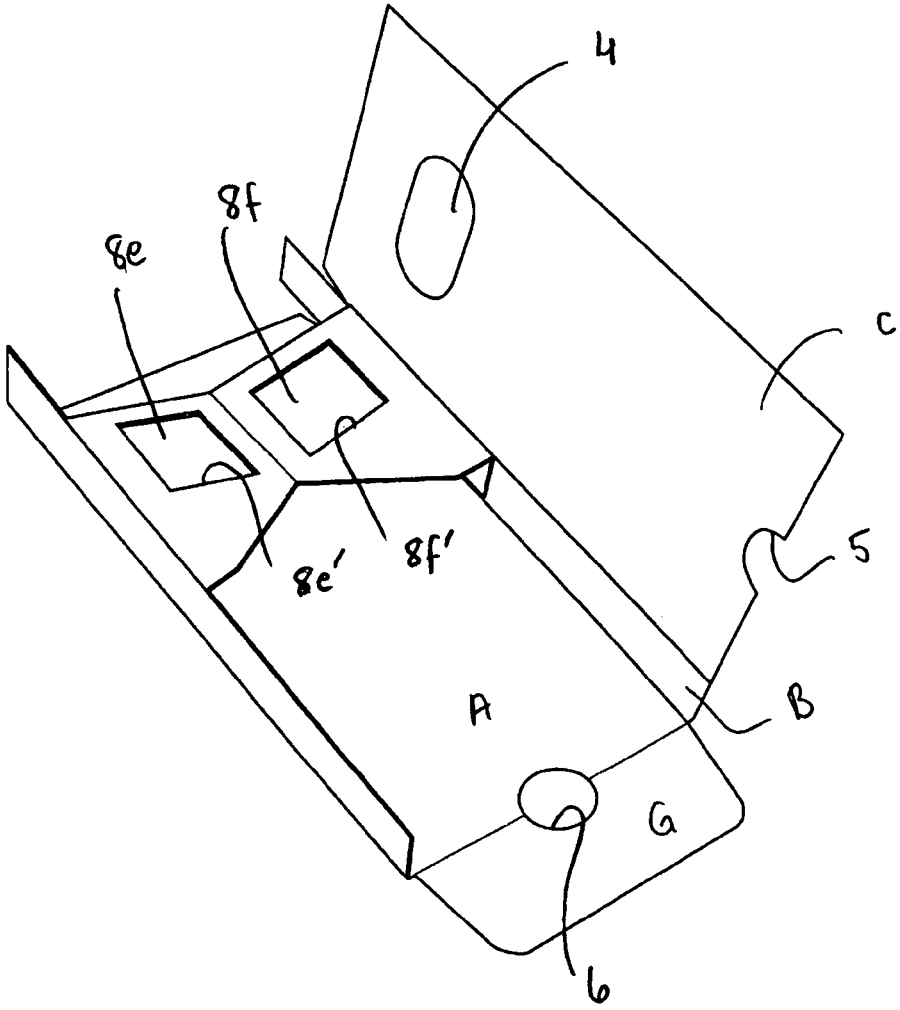
FIG. 12 is a perspective view showing parts of the blank of FIG. 9 with a locking tab being folded.
Figure 13:
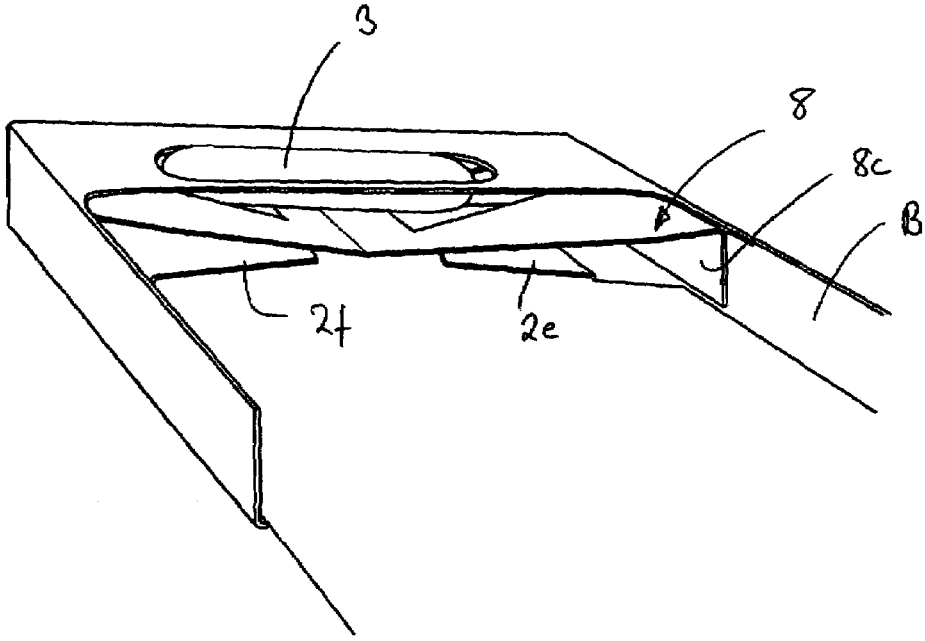
FIG. 13 is a perspective view showing the interaction of the blank of FIG. 12 and the insert of FIG. 11.
Figure 14:
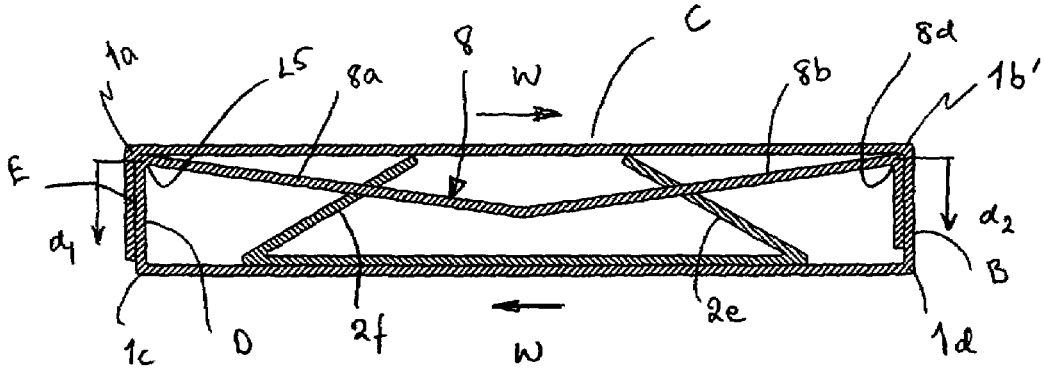
FIG. 14 is a cross-section corresponding to FIG. 13.

In accordance with a second basic embodiment, the blank and thus also the sleeve 1 is provided with a locking member 8. The locking member 8 is attached to the panel D along a fold line L5 also denoted fifth fold line. The locking member has two central panels 8*a* and 8*b* and a fastening panel 8*c*. The fastening panel 8*c* is adapted to be fastened to panel E as shown in FIG. 12 and FIG. 14. Panel 8*c* is connected to panel 8*b* along a fold line 8*d*. The distance between fold line L5 and the fold line 8*d* is larger than the distance between fold line L2 and L3, i.e. the width of the top panel C. Thus, when the sleeve 1 is erected the locking member 8 is forced to form an arc-shaped extension into the cross-section of the sleeve 1 as shown in FIG. 13 and FIG. 14.

In FIG. 14 the sleeve is flat-laid by translating the top surface C to the right in relation to the bottom surface A. This will result in that the geometrical line connecting fold line L3 with fold line L5 will rotate from being essentially 45° outwardly from the package to being essentially vertical. When considering the length of the locking member 8 and the top surface C, the available length of the top surface C will during this flat-laying be extended compared to the locking member 8 an amount corresponding to the difference in translation between the fold lines L3 and L5.

At the corner 1*b*' being refolded the geometrical line connecting fold line 8*d* and fold line L2 will change from being directed essentially 45° outwardly to about horizontally. Thus, also at this corner will the outer move more than the member, but the difference is smaller compared to the difference at the opposite corner 1*a*.

At the fold line being refolded (at corner 1*b*') the change due to fold line relative displacement will be the fold line distance (distance after flat-laying) minus sin45° of the fold line distance (distance before flat-laying) in favour of the outer material. At the flat laid fold line (corner 1*a*) the change will be sin45° of the fold line distance (distance before flat-laying) minus zero (distance after flat-laying) in favour of the outer material. Thus, the available length will increase about sin45°-(1-sin45°), i.e. about 0.4 of the fold line distance. It should be noted that the fold line distance is in the same order as the material thickness. Geometrically the fold line distance is about squareroot of 2 times the material thickness. These phenomena will occur irrespective of the flat-laying direction.

Moreover, since the upper left corner 1*a* will pivot about the left lower corner 1*c* being formed by the inner material of the left side D and the upper right corner 1*b*' will pivot about the right lower corner 1*d* being formed by the outer material B of the right side, the geometrical lever arms will make the inner left corner move less than the inner right corner and make the outer left corner move more than the outer right corner. Thus, the outer material will experience a geometrical extension compared to the inner material.

Thus, these phenomena act together when the sleeve is collapsed in the way denoted by the arrows W in FIG. 14. The locking member 8 will allow flat-laying of the sleeve 1 if the additional distance between fold line 8*d* and L5 compared to the width of the top panel C is equal the above described experienced lengthening of the top panel C.

The locking member 8 is provided with two through-going openings 8*e* and 8*f*. Insert 2 according to the second embodiment is provided with two locking tabs 2*e* and 2*f* in the same manner as in the first embodiment. The locking tabs 2*e* and 2*f* are foldable about to fold lines 2*g* and 2*h*. When the insert 2 is inserted into the sleeve 1 the locking tabs 2*e* and 2*f* will spring-back into the openings 8*e* and 8*f* and prevent the insert 2 from being pulled out of the sleeve 1.

The locking tabs 2*e* and 2*f* are provided with two trailing edges 2*e*' and 2*f*'. The openings 8*e* and 8*f* are each provided with a trailing edge 8*e*' and 8*f*' slightly slanted from being perpendicular to the sliding direction N. The angle of the fold lines 2*g* and 2*h*, the angle of the trailing edges of the locking tabs 2*e*' and 2*f*' and the trailing edges 8*e*' and 8*f*' of the openings 8*e* and 8*f* are chosen such that if a user starts pulling the insert 2 out of the sleeve 1, without pushing the button 3 first, the locking tabs 2*e* and 2*f* will at least partly pass the trailing edges 8*e*' and 8*f*' in the sliding direction. This results in that when the user push the button 3, the locking tabs 2*e* and 2*f* will not be allowed to be folded beneath the locking member 8. Thus, the user must push the insert back in again and then push the button before the insert 2 may be pulled out. Similarly, as in the first embodiment, the locking tabs 2*e* and 2*f* are provided with curved leading edges and the locking member is provided with a slanted leading edge. The locking function of the first embodiment may also be provided with this additional feature of forcing the user to push the button first. This is accomplished in the same manner as in the second embodiment, by slanting the trailing edge of the locking tab 2*e* compared to the trailing edge of the locking member. FIG. 13 shows how the push-button 3 pushes the locking tabs 2*e* and 2*f* back through the openings 8*e* and 8f, thus allowing the insert 2 to be pulled out of the sleeve 1.

As discussed above the locking member 8 may be lowered in the cross-section by lowering the fold lines L5 and 8*d* in relation to the corners 1*a* and 1*b*' along the distances d1 and d2. In order to further improve the experienced lengthening of the top panel C, fold line L5 may be lowered slightly more than fold line 8*d*.

As shown in the figures, the insert 2 may be formed as a so-called blister-pack carrying some kind of pharmaceuticals. It could however, be used to carry any kind of goods that you want to protect and perhaps make it difficult for kids to get access to. Thus, it could be used for razor blades, chemical substances or the like. The package could also be used for candy or other kind of small articles. The package-offers the possibility to store such items in a child-proof manner. It is also beneficial to use such a package in order to keep small items within the package when the package is carried in a pocket or a purse. The locking function will prevent the package from being opened by mistake and will thus prevent chewing gums or throat pastilles from falling out of the package.

It should also be noted that in the case of a reinforcement panel F being folded back an attached to the inside of the top panel C, the reinforcement panel F may be provided with a cut-out at the location where the locking member 7 otherwise would abut the reinforcement panel F. This way the locking member 7 will abut the top panel C even if there is a reinforcement panel F. Consequently, the space available for the locking member 7 will not be affected by the presence of any reinforcement member F.

It should also be noted that the package or blank might of course be provided with more than one locking member of the kind described above.

Furthermore, it should also be noted that the designs disclosed in the above description only allow the package to be opened if the button is pushed to release the locking member before the insert is pulled outwardly at all. It is also contemplated to have the locking member and locking tab formed with edges being perpendicular to the sliding direction and thus arrive in a design allowing the user to first pull the insert outwardly and thereafter push the button after realising that the insert is locked and still allowing the locking tab to pass the locking member. Other angles of the edges of the locking elements are also contemplated.

What is claimed is:

1. A package comprising a top panel, a bottom panel, a first side panel connecting the top panel and the bottom panel to each other and a second side panel also connecting the top panel and the bottom panel to each other; wherein the bottom panel, the first side panel, the top panel and the second side panel form a sleeve having an opening, the sleeve having a substantially rectangular cross-section, the cross-section being defined by the first side panel, the bottom panel, the second side panel and the top panel, wherein a first inside corner of the rectangle is defined by the top panel and the second side panel, and a second inside corner is defined by the second side panel and the bottom panel; wherein the sleeve is adapted to receive an insert slidable therein along a sliding direction normal to said rectangular cross-section; wherein the package further comprises a locking member disposed at the second side panel and including an arch-shaped portion extending in an arch-shaped direction into the rectangular cross-section from a first position adjacent the first inside corner to a second position adjacent the second inside corner, wherein the locking member has an extension greater than a linear distance between the first and second inside corners.

2. The package according to claim 1 wherein the first inside corner and the second inside corner are located at two opposite edges of one of said panels.

3. The package according to claim 2 wherein said one of said panels constitutes one of the side panels.

4. The package according to claim 1 wherein the bottom panel and the first side panel are foldable in relation to each other about a first fold line forming a hinge between the bottom panel and the first side panel, the first side panel and the top panel are foldable in relation to each other about a second fold line forming a hinge between the first side panel and the top panel, the top panel and the second side panel are foldable in relation to each other about a third fold line forming a hinge between the top panel and the second side panel, and wherein the second side panel and the bottom panel are foldable in relation to each other about a fourth fold line forming a hinge between the second side panel and the bottom panel.

5. The package according to claim 4, wherein the sleeve is collapsible by simultaneous folding of the side panels in one and the same folding direction about the first and third fold lines, respectively, in relation to the bottom panel such that the second side panel is folded towards the bottom panel, and wherein said first inside corner of the rectangle is defined by the top panel and the second side panel.

6. The package according to claim 1 wherein the second side panel comprises a first side panel portion connected to the bottom panel and a second side panel portion connected to the top panel, whereby an outer surface of the first portion abuts and is attached to an inner surface of the second portion.

7. The package according to claim 6, wherein the locking member is integrally formed with said first portion of the second side panel.

8. The package according to claim 1, wherein the arch-shaped portion comprises a first portion and a second portion, the first position being located at a first distance along the top panel from said first inside corner.

9. The package according to claim 8, wherein the first and second portions of the locking member are interconnected along a fold line parallel with said normal to said rectangle, and wherein a distance from the first position to the second position along the top panel and the second side panel substantially coincides with a distance from the first position to the second position along the first and second portions of the locking member.

10. The package according to claim 9, wherein the first portion is adapted to extend from said second position such that a geometric component along the bottom panel extends past the first position.

11. The package according to claim 8, wherein the locking member further comprises a third portion adapted to extend from said first position located at said first inner side corner along an inside surface of the top panel to the second portion, wherein the second and third portions of the locking member are interconnected along a fold line parallel with said normal to said rectangle.

12. The package according to claim 1, wherein said first inside corner of the rectangle is defined by the top panel and the second side panel and the second inside corner of the rectangle is defined by the top panel and the first side panel.

13. The package according to claim 12, wherein a first geometric distance is defined between said first position and said second position when the sleeve is erected and has a cross-section essentially formed as a rectangle and a second geometric distance is defined between said first position and said second position when the sleeve is collapsed such that the second side panel is folded against the bottom panel, wherein the second geometric distance is larger than said first geometric distance, and wherein the locking member has a length exceeding said first geometric distance and essentially coinciding with said second geometric distance.

14. The package according to claim 1 wherein the first position is at the first inside corner.

15. The package according to claim 1 wherein the arch-shaped portion comprises a continuous arch-shaped portion.

16. The package according to claim 1 wherein the arch-shaped portion comprises a broken arch-shaped portion.

17. A blank comprising a top panel, a bottom panel, a first side panel and a second side panel, the second side panel comprising a first portion and/or a second portion, wherein the bottom panel and the first side panel are foldable in relation to each other about a first fold line forming a hinge between the bottom panel and the first side panel, the first side panel and the top panel are foldable in relation to each other about a second fold line forming a hinge between the first side panel and the top panel, the top panel and the second portion of the second side panel are foldable in relation to each other about a third fold line forming a hinge between the top panel and the second portion of the second side panel, and wherein the first portion of the second side panel and the bottom panel are foldable in relation to each other about a fourth fold line forming a hinge between the first portion of the second side panel and the bottom panel, wherein said first, second, third and fourth fold lines are parallel with each other, wherein the blank further comprises a locking member extending from said first portion of the second side panel in a direction perpendicular to said first, second, third and fourth fold lines, that the locking member and the first portion of the second side panel are foldable in relation to each other about a fifth fold line forming a hinge between said first portion of the second side panel and the locking member, the fourth fold line and the fifth fold line are parallel with each other and between them define said first portion, and that the locking member includes a fastening panel adapted to be positioned against and fastened to an inside surface of one of the bottom panel or the first side panel.

18. The blank according to claim 17, wherein the locking member is integrally formed with said first portion of the second side panel.

19. The blank according to claim 17, wherein the locking member is provided with an eighth fold line parallel with said fifth or seventh fold line, and wherein a sum of a distance between the eighth fold line and the fastening panel along the locking member and a distance between the fourth fold line and a designated fastening point of the fastening panel on the bottom panel is equal to a sum of a distance between the fourth and third fold lines as the blank is formed into a package and a distance between one of said fifth or seventh fold line and the eighth fold line.

20. The blank according to claim 17, wherein a first geometric distance defined between the fifth fold line and the fastening panel is larger than or equal to a second distance defined between the second and the third fold lines.

21. The blank according to claim 17 wherein the second side panel comprises first and second portions forming hinges with the bottom and top panels, respectively, the locking member extending from the first portion of the second side panel.

22. A blank comprising a top panel, a bottom panel, a first side panel and a second side panel, the second side panel comprising a first portion and/or a second portion, wherein the bottom panel and the first side panel are foldable in relation to each other about a first fold line forming a hinge between the bottom panel and the first side panel, the first side panel and the top panel are foldable in relation to each other about a second fold line forming a hinge between the first side panel and the top panel, the top panel and the second portion of the second side panel are foldable in relation to each other about a third fold line forming a hinge between the top panel and the second portion of the second side panel, and wherein the first portion of the second side panel and the bottom panel are foldable in relation to each other about a fourth fold line forming a hinge between the first portion of the second side panel and the bottom panel, wherein said first, second, third and fourth fold lines are parallel with each other, wherein the blank further comprises a locking member and a reinforcement panel, that the top panel and reinforcement panel are foldable in relation to each other about a sixth fold line forming a hinge between the top panel and the reinforcement panel, that the sixth fold line is perpendicular to said first, second, third and fourth fold lines, that the locking member extends from said reinforcement panel in a direction being perpendicular to said first, second, third and fourth fold lines, that the locking member and the reinforcement panel are foldable in relation to each other about a seventh fold line forming a hinge between said reinforcement panel and the locking member, that the seventh fold line is parallel with said first, second, third and fourth fold lines, and that the locking member comprises a fastening panel being adapted to be positioned against and fastened to an inside surface of one of the bottom panel or the first side panel.

23. The blank according to claim 22, wherein the locking member is integrally formed with said reinforcement panel.

24. The blank according to claim 22 wherein the second side panel comprises first and second portions forming hinges with the bottom and top panels, respectively, the locking member extending from the first portion of the second side panel.

25. A package comprising a top panel, a bottom panel, a first side panel arrangement connecting the top panel and the bottom panel to each other and a second side panel arrangement also connecting the top panel and the bottom panel to each other; wherein the bottom panel, the first side panel arrangement, the top panel and the second side panel arrangement form a sleeve having an opening; the sleeve having a substantially rectangular cross-section, the cross-section being defined by the first side panel, the bottom panel, the second side panel and the top panel, wherein the sleeve is adapted to receive an insert slidable therein along a sliding direction normal to said rectangular cross-section; wherein the package further comprises a locking member disposed at one of the first and second side panel arrangements and including an arch-shaped portion extending in an arch-shaped direction into the rectangular cross-section from a location adjacent a first inside corner to a location adjacent a second inside corner, wherein the locking member has an extension greater than a linear distance between the first and second inside corners, and wherein the first inside corner is defined by the top panel and the second side panel, and the second inside corner is defined by the second side panel and the bottom panel.

* * * * *